US011459643B2

(12) United States Patent
Dong et al.

(10) Patent No.: US 11,459,643 B2
(45) Date of Patent: Oct. 4, 2022

(54) HIGH-STRENGTH AND HIGH-TOUGHNESS PERFORATING GUN TUBE AND MANUFACTURING METHOD THEREFOR

(71) Applicant: BAOSHAN IRON & STEEL CO., LTD., Shanghai (CN)

(72) Inventors: Xiaoming Dong, Shanghai (CN); Zhonghua Zhang, Shanghai (CN); Cunyao Zhao, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 235 days.

(21) Appl. No.: 16/463,634

(22) PCT Filed: Nov. 29, 2017

(86) PCT No.: PCT/CN2017/113460

§ 371 (c)(1),
(2) Date: May 23, 2019

(87) PCT Pub. No.: WO2018/099381

PCT Pub. Date: Jun. 7, 2018

(65) Prior Publication Data

US 2019/0316234 A1 Oct. 17, 2019

(30) Foreign Application Priority Data

Nov. 30, 2016 (CN) ..... 201611083853.1

(51) Int. Cl.

| | |
|---|---|
| ***C22C 38/02*** | (2006.01) |
| ***B22D 11/00*** | (2006.01) |
| ***B22D 11/115*** | (2006.01) |
| ***C21D 8/10*** | (2006.01) |
| ***C22C 38/00*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *C22C 38/02* (2013.01); *B22D 11/002* (2013.01); *B22D 11/006* (2013.01); *B22D 11/115* (2013.01); *C21D 8/105* (2013.01); *C22C 38/001* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01)

(58) Field of Classification Search

CPC ... B22D 11/115; B22D 11/006; B22D 11/002; C21D 8/10; C21D 211/001; C21D 11/008; C21D 9/08; C21D 8/105; C22C 38/02; C22C 38/001; C22C 38/04; C22C 38/06; C22C 38/22; C22C 38/24; C22C 38/26; C22C 38/28; C22C 38/32

See application file for complete search history.

(56) References Cited

U.S. PATENT DOCUMENTS

| | | | | |
|---|---|---|---|---|
| 8,137,484 B2 * | 3/2012 | Hashimura | ..... | C22C 38/04 148/546 |
| 2012/0042992 A1 * | 2/2012 | Kondo | ..... | C21D 9/085 148/504 |

FOREIGN PATENT DOCUMENTS

| | | | |
|---|---|---|---|
| CN | 101532113 A | | 9/2009 |
| CN | 101660036 A | * | 3/2010 |
| CN | 101845586 A | | 9/2010 |
| CN | 102776441 | | 11/2012 |
| CN | 103938094 A | | 7/2014 |
| CN | 103938095 A | | 7/2014 |
| CN | 104513936 | | 4/2015 |
| CN | 104789875 | | 7/2015 |
| CN | 105441801 A | | 3/2016 |
| JP | 58174550 | | 10/1983 |
| SU | 1567653 | | 5/1990 |

OTHER PUBLICATIONS

International Search Report and Written Opinion dated Mar. 9, 2018 for PCT Patent Application PCT/CN2017/113460.
1st Search Report dated Mar. 25, 2019 for Chinese Patent Application No. 201611083853.
1st Office Action dated Mar. 28, 2019 for Chinese Patent Application No. 201611083853.
Supplementary Search Report dated Sep. 18, 2019 for Chinese Patent Application No. 201611083853.
2nd Office Action dated Sep. 25, 2019 for Chinese Patent Application No. 201611083853.
3rd Office Action dated Feb. 3, 2020 for Chinese Patent Application No. 201611083853.
Notification to Grant dated Jul. 8, 2020 for Chinese Patent Application No. 201611083853.

* cited by examiner

*Primary Examiner* — Christopher S Kessler
(74) *Attorney, Agent, or Firm* — Lei Fang, Esq.; Smith Tempel Blaha LLC

(57) ABSTRACT

A high-strength and high-toughness tube for perforating gun, having a formulation of chemical elements in percentage by mass as follows: C: 0.15%-0.22%, Si: 0.1%-0.4%, Mn: 0.5%-1%, Cr: 0.3%-0.7%, Mo: 0.3%-0.7%, Nb: 0.01%-0.04%, V: 0.1%-0.2%, Ti: 0.02%-0.05%, B: 0.0015%-0.005%, Al: 0.01%-0.05%, Ca: 0.001%-0.004%, N≤0.008%, and the balance of Fe and other inevitable impurities. Accordingly, further disclosed is a method for manufacturing a high-strength and high-toughness tube for perforating gun. The high-strength and high-toughness tube for perforating gun of the present invention has high strength, good toughness and uniform circumferential strength, and is suitable for application in the field of petroleum exploration and exploitation.

12 Claims, 2 Drawing Sheets

HIGH-STRENGTH AND HIGH-TOUGHNESS PERFORATING GUN TUBE AND MANUFACTURING METHOD THEREFOR

CROSS-REFERENCE TO RELATED APPLICATIONS

This application is a 371 U.S. National Phase of PCT International Application No. PCT/CN2017/113460 filed on Nov. 29, 2017, which claims benefit and priority to Chinese patent application no. 201611083853.1, filed on Nov. 30, 2016. Both of the above-referenced applications are incorporated by reference herein in their entireties.

TECHNICAL FIELD

The invention relates to a tube for perforating gun and a manufacturing method thereof, in particular to a tube for perforating gun used in the field of petroleum exploitation and a manufacturing method thereof.

BACKGROUND ART

Perforation is an extremely important technology in system engineering of petroleum exploration and exploitation and one of the important means to improve recovery efficiency of oil and gas well. In the perforating operation, a tube for perforating gun can be used as a charge carrier to position the perforation direction, and can also play a role in protecting the detonating devices for perforating from the fluid in the well, withstanding the pressure and reducing the damage to the downhole casing during the perforating operation, and protecting the production casing during the explosion. Due to the poor working conditions, the gun tube is mainly affected by high pressure and huge shock waves generated by the firing of the perforating charge, in addition to the effects of medium corrosion, temperature and pressure of well. Therefore, the requirements for the quality, strength and toughness (especially the transverse impact toughness) of the tube for perforating gun are very strict.

The tube for perforating gun is not only required to have strong collapse resistance, but also needs to withstand the high pressure environment generated by deep well and firing of the perforating charge, and have a good expansive deformation resistance to effectively prevent stuck. In addition, besides of the requirements on the strength of the tube for perforating gun, it is also desirable to reduce the thickness of the gun body to improve the quality of perforation. Therefore, the tube for perforating gun is required to have high strength, as well as high toughness. When the toughness of the high-strength tube for perforating gun is insufficient, especially when the transverse impact toughness is low, the perforation burrs is increased, and even the gun body may crack, causing accidents such as stucking in a wellbore. In addition, in consideration of the perforation quality of the tube for perforating gun, it is required that the gun tube has high circumferential strength uniformity.

A Chinese patent document titled "Seamless steel pipe for perforating gun barrel body and thermal treatment method of seamless steel pipe" with a publication number of CN103352169A and a publication date of Oct. 16, 2013 disclosed a seamless steel pipe for a perforating gun barrel body. The strength of the seamless steel pipe for a perforating gun barrel body prepared by the technical solution disclosed in the patent document reaches steel grade 150 ksi. However, the process is complicated due to two quenching and tempering heat treatments, and the cost is high.

A Chinese patent document titled "Rare earth-containing body of perforating gun and preparation method thereof" with a publication number of CN103614631A and a publication date of Mar. 5, 2014 disclosed a rare earth-containing body of a perforating gun. In this patent, the toughness index is improved by adding rare earth elements to improve the morphology of inclusions. However, the tube for perforating gun disclosed in this patent has a yield strength of 863~882 MPa and a tensile strength of 951~965 MPa.

A Japanese patent document titled "Steel tube and its manufacture" with a publication number of JPH11131189A and a publication date of May 18, 1999 disclosed a steel tube. In this patent, heating is carried out at a temperature of 400~750° C., and then rolling is performed at a deformation of 20% or more (or 60% or more) to produce a steel tube product having a yield strength of 950 MPa or more and good toughness. However, since the heating temperature in the process disclosed in the patent document is low, the rolling is difficult, and thus it is difficult to be used for industrial mass production, and at the same time, martensite structure is easily generated due to the low rolling temperature.

SUMMARY OF THE INVENTION

One of the objects of the present invention is to provide a high-strength and high-toughness tube for perforating gun which has high strength, good toughness and uniform circumferential strength.

Based on the above object, the present invention provides a high-strength and high-toughness tube for perforating gun, comprising the following chemical elements by mass percentages:

C: 0.15%-0.22%, Si: 0.1%-0.4%, Mn: 0.5%-1%, Cr: 0.3%-0.7%, Mo: 0.3%-0.7%, Nb: 0.01%-0.04%, V: 0.1%-0.2%, Ti: 0.02%-0.05%, B: 0.0015%-0.005%, Al: 0.01%-0.05%, Ca: 0.001%-0.004%, N≤0.008%, and the balance of Fe and other inevitable impurities.

The design principles of each chemical element of the high-strength and high-toughness tube for perforating gun of the present invention is as follows:

C: In the technical solution of the present invention, carbon is a precipitate forming element, which can improve the strength of steel. When the mass percentage of carbon is less than 0.15%, the hardenability is low, and the toughness is low, making the high-strength and high-toughness tube for perforating gun difficult to achieve the requirements of high strength. When the mass percentage of carbon is higher than 0.22%, carbon forms a large amount of coarse precipitates with Cr and Mo, and significantly increases the segregation of steel, which significantly reduces the toughness of the tube for perforating gun, making the tube for perforating gun difficult to achieve the requirements of high strength and high toughness. Therefore, in the high-strength and high-strength tube for perforating gun of the present invention, the mass percentage of C is controlled to 0.15~0.22%.

Si: Silicon is solid-solubilized in ferrite to increase the yield strength of steel. However, when the mass percentage of silicon is higher than 0.4%, the processability and toughness are deteriorated. When the mass percentage of silicon is less than 0.1%, the steel is easily oxidized. Therefore, in the high-strength and high-toughness tube for perforating gun of the present invention, the mass percentage of silicon is controlled to 0.1%~0.4%.

Mn: Manganese is an austenite forming element and can improve the hardenability of steel. In the technical solution of the present invention, when the mass percentage of manganese is less than 0.5%, the hardenability of the steel is significantly lowered and the proportion of martensite is lowered, resulting in a decrease in toughness. When the mass percentage of manganese is more than 1%, the segregation of the structure in the steel is significantly increased, which affects the uniformity and impact performance of the hot rolled structure. Therefore, in the high-strength and high-toughness tube for perforating gun of the present invention, the mass percentage of Mn is defined to 0.5~1.0%.

Cr: In the high-strength and high-toughness tube for perforating gun, chromium strongly enhances hardenability and is a strong precipitate forming element, and the precipitates precipitated during tempering can increase the strength of the steel. However, when the mass percentage of chromium is higher than 0.7%, coarse $M_{23}C_6$ precipitates are liable to precipitate at the grain boundaries, reducing the toughness of the high-strength and high-toughness tube for perforating gun. When the mass percentage of chromium is less than 0.3%, the hardenability of the steel of the high-strength and high-toughness tube for perforating gun is insufficient. Therefore, in the high-strength and high-toughness tube for perforating gun of the present invention, the mass percentage of Cr is 0.3~0.7%.

Mo: In the technical solution of the present invention, the strength and tempering stability of the steel are improved by controlling the precipitates and solid solution strengthening. Since the high-strength and high-toughness tube for perforating gun of the present invention has a low carbon content, when the mass percentage of molybdenum added is higher than 0.7%, it is likely to form segregation structures. When the mass percentage of molybdenum is less than 0.3%, high strength cannot be achieved. Therefore, in the high-strength and high-toughness tube for perforating gun of the present invention, the mass percentage of Mo is 0.3~0.7%.

Nb: Niobium is a strengthening element for grain refinement and precipitation, and can compensate for the decrease in strength due to carbon reduction. In addition, niobium has good anti-tempering stability, which is beneficial to improve the strength uniformity of different positions of the high-strength and high-toughness tube for perforating gun. When the mass percentage of niobium is less than 0.01%, the effect thereof is not obvious. When the mass percentage of niobium is higher than 0.04%, coarse niobium (CN) is easily formed, which reduces the toughness of the high-strength and high-toughness tube for perforating gun. Therefore, in the high-strength and high-toughness tube for perforating gun of the present invention, the mass percentage of Nb is 0.01%-0.04%.

V: Vanadium is a typical precipitation strengthening element that compensates for the decrease in strength due to carbon reduction. In addition, vanadium has good anti-tempering stability, which is beneficial to improve the strength uniformity of different positions of the high-strength and high-toughness tube for perforating gun. When the mass percentage of vanadium is less than 0.1%, the strengthening effect is insufficient to achieve the high strength requirement of the high-strength and high-toughness tube for perforating gun. When the mass percentage of vanadium is higher than 0.2%, coarse vanadium (CN) is easily formed, which reduces the toughness of the high-strength and high-toughness tube for perforating gun. Therefore, in the high-strength and high-toughness tube for perforating gun of the present invention, the mass percentage of V is limited to 0.1%-0.2%.

Ti: Titanium is a strong carbonitride forming element, which remarkably refines austenite grains and compensates for the decrease in strength due to carbon reduction. When the mass percentage of titanium is higher than 0.05%, coarse TiN is easily formed, which reduces the toughness of the high-strength and high-toughness tube for perforating gun of the present invention.

B: Boron also significantly improves hardenability. In the solution of the present invention, boron is used to solve the problem of poor hardenability due to low carbon content. When the mass percentage of boron is less than 0.0015%, the effect of improving hardenability is not remarkable. When the mass percentage of boron is higher than 0.005%, the BN brittle phase is easily formed, which reduces the toughness of the high-strength and high-toughness tube for perforating gun. Therefore, in the high-strength and high-toughness tube for perforating gun of the present invention, the mass percentage of B is controlled to 0.0015%~0.005%.

Al: Aluminum is a good deoxidizing and nitrogen-fixing element, which can refine grains. Therefore, in the technical solution of the present invention, the mass percentage of Al is controlled to 0.01~0.05%.

Ca: In the technical solution of the present invention, calcium can purify molten steel, promote the spheroidization of MnS, and improve the impact toughness of the high-strength and high-toughness tube for perforating gun of the present invention. However, when the mass percentage of calcium is higher than 0.004%, coarse non-metallic inclusions are easily formed.

N: Nitrogen is a harmful impurity element in steel. If the content of nitrogen is too high, the toughness of the steel will be reduced. Therefore, the mass percentage of nitrogen is controlled to 0.008% or less.

In the technical solution of the present invention, the main unavoidable impurities include P and S, which is disadvantageous to the improvement of the toughness of the high-strength and high-toughness tube for perforating gun of the present invention. Therefore, the mass percentages thereof are controlled to: $P \leq 0.015$, $S \leq 0.003$.

Further, in the high-strength and high-toughness tube for perforating gun of the present invention, the following formula is also satisfied: $0 < (Ti-3.4N) < 0.025\%$. In order to ensure sufficient combination of Ti and N to prevent the forming of a BN brittle phase (formed by B and N) which reduces the toughness of the steel, Ti and N are further defined in the present invention, that is, Ti and N also need to satisfy the above formula.

Further, in the high-strength and high-toughness tube for perforating gun of the present invention, the following formula is also satisfied: $Ca/S \geq 1.5$.

In order to further improve the toughness of the high-strength and high-toughness tube for perforating gun of the present invention, the inventors of the present invention found that by defining the mass percentage ratio of Ca to S, the effect of eliminating MnS inclusions by Ca can be further enhanced. Therefore, in the high-strength and high-toughness tube for perforating gun of the present invention, the following formula is also satisfied: $Ca/S \geq 1.5$.

Further, in the high-strength and high-toughness tube for perforating gun of the present invention, the microstructure is tempered sorbite.

Further, in the high-strength and high-toughness tube for perforating gun of the present invention, the grain size is level 9 or more, and the MnS inclusion in the high-strength and high-toughness tube for perforating gun is in a level of 0.5 or less.

Further, in the high-strength and high-toughness tube for perforating gun of the present invention, the yield strength is 896~1103 MPa, the tensile strength is 965 MPa or more, and the transverse Charpy impact energy at 0° C. is 130 J or more, and the yield strength of the high-strength and high-toughness tube for perforating gun has a range of 60 MPa or less, and the tensile strength of the tube has a range of 60 MPa or less.

Further, in the high-strength and high-toughness tube for perforating gun of the present invention, the yield strength is 965~1173 MPa, the tensile strength is 1034 MPa or more, and the transverse Charpy impact energy at 0° C. is 130 J or more, and the yield strength of the high-strength and high-toughness tube for perforating gun has a range of 60 MPa or less, and the tensile strength of the tube has a range of 60 MPa or less.

Further, in the high-strength and high-toughness tube for perforating gun of the present invention, the yield strength is 1069~1276 MPa, the tensile strength is 1138 MPa or more, and the transverse Charpy impact energy at 0° C. is 120 J or more, and the yield strength of the high-strength and high-toughness tube for perforating gun has a range of 60 MPa or less, and the tensile strength of the tube has a range of 60 MPa or less.

It should be noted that the term of "range" of yield strength or tensile strength is defined as: selecting several test points along the circumferential direction of the tube for perforating gun, and measuring the axial yield strength and axial tensile strength of these test points, the difference between the maximum and the minimum value of axial yield strengths, or the difference between the maximum and the minimum value of tensile strengths among these points. Therefore, a "range" of 60 MPa or less indicates that the tube for perforating gun has good strength uniformity and can improve the perforating quality.

In addition, another object of the present invention is to provide a manufacturing method for the high-strength and high-toughness tube for perforating gun described above, comprising the steps of:

(1) smelting;

(2) casting: casting into a round billet, wherein an electromagnetic stirring process under a current of 600~650 A and a frequency of 8~20 Hz is used to reduce the dendrite segregation of tube blank, and the superheating degree of liquid steel in the casting process is controlled to less than 30° C.;

(3) rolling;

(4) heat treatment;

(5) hot-sizing.

In the technical solution of the present invention, in order to ensure good perforating performance of the tube for perforating gun, the steel used in the tube for perforating gun is required to have high transverse impact toughness and maintain the stability of the mechanical properties of the tube body. There are more factors affecting the transverse impact toughness than factors affecting the longitudinal impact toughness. The MnS inclusions formed in the steel of high-strength and high-toughness tube for perforating gun significantly reduce the transverse impact toughness of the steel. Furthermore, the dendrite segregation formed during the casting process forms banded structure segregation after rolling of the tube, which also affects the transverse impact toughness of the steel. Conversely, the above two factors have no significant effect on the longitudinal impact toughness.

Therefore, in order to improve the strength and toughness of the high-strength and high-toughness tube for perforating gun of the present invention, the parameters of the casting process in the step (2) are adjusted to reduce the dendrite segregation of the tube blank. Moreover, the control of the MnS inclusions is achieved by rationally optimizing the ratio of the chemical elements.

It should be noted that, in order to further reduce the MnS inclusions, in the step (1), after smelting by an electric furnace, external refining, vacuum degassing and argon stirring may be carried out to reduce the contents of O and H, thereby realizing the control the MnS inclusions. Further, in the step (1), those skilled in the art can also perform inclusion denaturation by Ca treatment to further reduce the content of MnS inclusions.

Further, in the manufacturing method of the present invention, in the step (3), the tube blank is soaked at 1200~1240° C., and then pierced at a temperature of 1180~1240° C.; the rolling temperature is controlled at 950~1000° C.; the temperature of the reheating furnace is 950~1000° C.; the stretch reducing temperature is 900~950° C.

Further, in the manufacturing method of the present invention, in the step (4), first, quenching is performed at a quenching temperature of 880~920° C., and the holding time is 30~60 min; then, tempering is performed at a tempering temperature of 550~650° C., and the holding time is 50~80 min.

Further, in the manufacturing method of the present invention, in the step (5), the temperature of hot-sizing is 500~550° C.

When the strength of the high-strength and high-toughness tube for perforating gun of the present invention reaches 130 ksi steel grade, the yield strength is 896~1103 MPa, the tensile strength is 965 MPa or more, and the transverse Charpy impact energy at 0° C. is 130 J or more, and the yield strength of the high-strength and high-toughness tube for perforating gun has a range of 60 MPa or less, and the tensile strength of the tube has a range of 60 MPa or less.

When the strength of the high-strength and high-toughness tube for perforating gun of the present invention reaches 140 ksi steel grade, the yield strength is 965~1173 MPa, the tensile strength is 1034 MPa or more, and the transverse Charpy impact energy at 0° C. is 130 J or more, and the yield strength of the high-strength and high-toughness tube for perforating gun has a range of 60 MPa or less, and the tensile strength of the tube has a range of 60 MPa or less.

When the strength of the high-strength and high-toughness tube for perforating gun of the present invention reaches 155 ksi steel grade, the yield strength is 1069~1276 MPa, the tensile strength is 1138 MPa or more, and the transverse Charpy impact energy at 0° C. is 120 J or more, and the yield strength of the high-strength and high-toughness tube for perforating gun has a range of 60 MPa or less, and the tensile strength of the tube has a range of 60 MPa or less.

Moreover, the manufacturing method of the present invention is simple in process and easy to implement in a mass production. The high-strength and high-toughness tube for perforating gun obtained by the manufacturing method of the invention has the advantages of high strength and good toughness.

DETAILED DESCRIPTION

Figure 1:
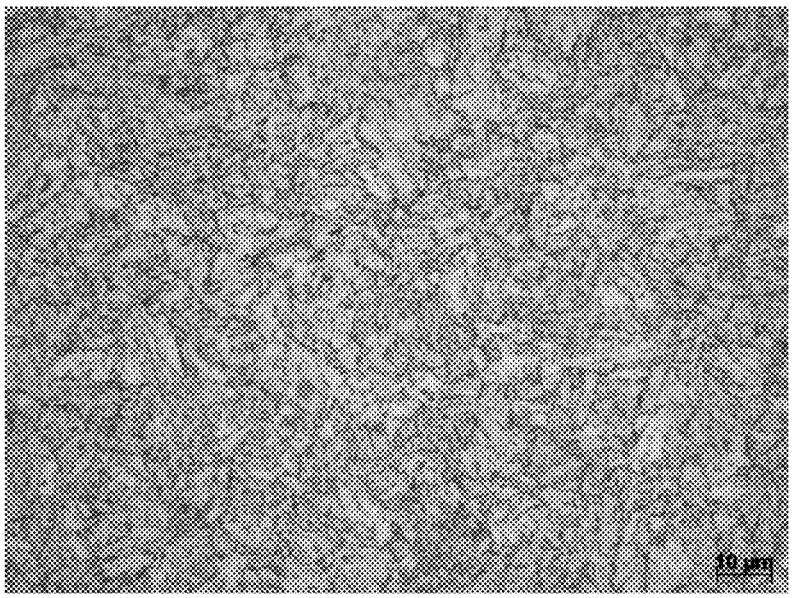
FIG. 1 shows the microstructure of the high-strength and high-toughness tube for perforating gun of Example 5.

The high-strength and high-toughness tube for perforating gun and manufacturing method thereof of the present invention will be further explained and illustrated below with reference to the accompanying drawings and specific Examples. However, the explanations and illustrations do not unduly limit the technical solutions of the present invention.

Examples 1-5 and Comparative Examples 1-5

The high-strength and high-toughness tubes for perforating gun of Examples 1-5 and the conventional tubes for perforating gun of Comparative Examples 1-5 were obtained by the following steps:

(1) smelting: the initial smelting is carried out in an electric furnace, wherein the mass percentage of each chemical element was controlled according to Table 1; after primary smelting, external refining, vacuum degassing and argon stirring were carried out; then, inclusion denaturation were carried out by Ca treatment to reduce the content of inclusions;

(2) casting: casting into a round billet, using electromagnetic stirring process in the casting process, the current in electromagnetic stirring was 600~650A and the frequency was 8~20 Hz to reduce the dendrite segregation of tube blank, and the superheating degree of liquid steel in the casting process is controlled to less than 30° C.;

(3) rolling: the tube blank was soaked at 1200~1240° C., and then perforated at a temperature of 1180~1240° C.; the rolling temperature was controlled to 950~1000° C.; the temperature of the reheating furnace was 950~1000° C.; the stretch reducing temperature is 900~950° C.;

(4) heat treatment: first, quenching was performed at a quenching temperature of 880~920° C., and the holding time was 30~60 min; then, tempering was performed at a tempering temperature of 550~650° C., and the holding time was 50~80 min;

(5) hot-sizing: the temperature of hot-sizing was 500~550° C.

Table 1 lists the mass percentages of chemical elements of high-strength and high-toughness tubes for perforating gun of Examples 1-5 and conventional tubes for perforating gun of Comparative Examples 1-5.

TABLE 1

(wt %, the balance is Fe and other inevitable impurities other than P and S)

| | C | Si | Mn | Cr | Mo | Nb | V | Ti | B | Al | Ca | P | S | N | Ti − 3.4 * N | Ca/S |
|---|---|---|---|---|---|---|---|---|---|---|---|---|---|---|---|---|
| Example 1 | 0.15 | 0.2 | 0.5 | 0.3 | 0.5 | 0.01 | 0.1 | 0.02 | 0.0015 | 0.01 | 0.002 | 0.009 | 0.0012 | 0.004 | 0.0064 | 1.7 |
| Example 2 | 0.17 | 0.1 | 0.7 | 0.4 | 0.6 | 0.02 | 0.12 | 0.03 | 0.002 | 0.04 | 0.0015 | 0.01 | 0.001 | 0.005 | 0.013 | 1.5 |
| Example 3 | 0.19 | 0.3 | 0.9 | 0.5 | 0.7 | 0.01 | 0.14 | 0.04 | 0.003 | 0.05 | 0.002 | 0.01 | 0.003 | 0.006 | 0.0196 | 1.7 |
| Example 4 | 0.21 | 0.4 | 1 | 0.6 | 0.3 | 0.01 | 0.16 | 0.05 | 0.004 | 0.03 | 0.0035 | 0.012 | 0.002 | 0.008 | 0.0228 | 1.75 |
| Example 5 | 0.22 | 0.25 | 1.5 | 0.7 | 0.4 | 0.04 | 0.2 | 0.04 | 0.005 | 0.02 | 0.004 | 0.013 | 0.002 | 0.007 | 0.0162 | 2 |
| Comparative Example 1 | 0.08 | 0.2 | 0.5 | 0.3 | 0.5 | 0.01 | 0.05 | 0.02 | 0.0015 | 0.01 | 0.002 | 0.009 | 0.0012 | 0.004 | 0.0064 | 1.7 |
| Comparative Example 2 | 0.28 | 0.1 | 0.7 | 1.2 | 0.6 | 0.02 | 0.12 | 0.03 | 0.002 | 0.04 | 0.0015 | 0.01 | 0.001 | 0.005 | 0.013 | 1.5 |
| Comparative Example 3 | 0.2 | 0.1 | 0.7 | 0.5 | 0.6 | 0.02 | 0.12 | 0 | 0 | 0.04 | 0.0015 | 0.01 | 0.001 | 0.005 | −0.017 | 1.5 |
| Comparative Example 4 | 0.19 | 0.3 | 0.9 | 0.5 | 0.7 | 0.01 | 0.14 | 0.02 | 0.003 | 0.05 | 0.005 | 0.01 | 0.003 | 0.007 | −0.0038 | 1.7 |
| Comparative Example 5 | 0.19 | 0.3 | 0.9 | 0.5 | 0.9 | 0.01 | 0.14 | 0.03 | 0.003 | 0.05 | 0.002 | 0.01 | 0.003 | 0.007 | 0.0062 | 0.7 |

Table 2 lists the specific process parameters of the manufacturing methods of the Examples and the Comparative Examples.

TABLE 2

| | tube blank soaking temperature (° C.) | Electromagnetic stirring current (A) | Frequency (Hz) | Perforating temperature (° C.) | Finishing temperature (° C.) | Reheating furnace temperature (° C.) |
|---|---|---|---|---|---|---|
| Example 1 | 1220 | 600 | 8 | 1180 | 950 | 960 |
| Example 2 | 1230 | 610 | 10 | 1190 | 960 | 970 |
| Example 3 | 1240 | 620 | 12 | 1220 | 970 | 980 |
| Example 4 | 1200 | 630 | 15 | 1230 | 990 | 965 |
| Example 5 | 1210 | 640 | 18 | 1240 | 1000 | 1000 |
| Comparative Example 1 | 1230 | 630 | 15 | 1220 | 970 | 980 |
| Comparative Example 2 | 1240 | 630 | 15 | 1230 | 990 | 965 |
| Comparative Example 3 | 1200 | 630 | 15 | 1240 | 1000 | 1000 |
| Comparative Example 4 | 1200 | 630 | 15 | 1180 | 960 | 1000 |

TABLE 2-continued

| | | | | | | |
|---|---|---|---|---|---|---|
| Comparative Example 5 | 1220 | 630 | 15 | 1190 | 970 | 980 |

| | Stretch reducing temperature (° C.) | Quenching temperature (° C.) | Holding time (min) | Tempering temperature (° C.) | Holding time (min) | hot-sizing temperature (° C.) |
|---|---|---|---|---|---|---|
| Example 1 | 900 | 880 | 50 | 550 | 50 | 500 |
| Example 2 | 910 | 890 | 30 | 580 | 60 | 510 |
| Example 3 | 920 | 900 | 60 | 630 | 60 | 520 |
| Example 4 | 930 | 910 | 60 | 650 | 80 | 530 |
| Example 5 | 950 | 920 | 40 | 610 | 70 | 550 |
| Comparative Example 1 | 920 | 930 | 40 | 620 | 70 | 530 |
| Comparative Example 2 | 930 | 930 | 60 | 620 | 60 | 520 |
| Comparative Example 3 | 950 | 940 | 40 | 620 | 60 | 530 |
| Comparative Example 4 | 950 | 930 | 60 | 620 | 60 | 530 |
| Comparative Example 5 | 920 | 930 | 60 | 620 | 60 | 530 |

The performance tests were carried out using samples of high-strength and high-toughness tubes for perforating gun of Examples 1-5 and conventional tubes for perforating gun of Comparative Examples 1-5. The results obtained by the test are listed in Table 3.

Table 3 lists the results obtained by the test of high-strength and high-toughness tubes for perforating gun of Examples 1-5 and conventional tubes for perforating gun of Comparative Examples 1-5.

TABLE 3

| | Yield strength (MPa) | Tensile strength (MPa) | Elongation (%) | Transverse impact energy, 0° C. (J) | Range of yield strength (MPa) | Range of tensile strength (MPa) |
|---|---|---|---|---|---|---|
| Example 1 | 980 | 1040 | 25 | 145 | 50 | 40 |
| Example 2 | 1040 | 1160 | 21 | 135 | 40 | 50 |
| Example 3 | 1080 | 1190 | 19 | 132 | 50 | 50 |
| Example 4 | 1100 | 1180 | 20 | 138 | 40 | 40 |
| Example 5 | 1120 | 1200 | 18 | 128 | 40 | 50 |
| Comparative Example 1 | 820 | 900 | 25 | 120 | 40 | 50 |
| Comparative Example 2 | 960 | 1100 | 18 | 70 | 90 | 80 |
| Comparative Example 3 | 950 | 1050 | 22 | 82 | 80 | 80 |
| Comparative Example 4 | 1000 | 1100 | 18 | 79 | 50 | 60 |
| Comparative Example 5 | 1100 | 1100 | 18 | 73 | 50 | 50 |

As can be seen from Table 3, the yield strength, tensile strength and transverse impact energy of the Examples of the present application are significantly higher than that of the Comparative Examples, indicating that the Examples of the present application has high strength and good toughness. In addition, the ranges of yield strength of the Examples are 60 MPa or less, and the ranges of tensile strength of the Examples are also 60 MPa or less, indicating that the Examples have uniform circumferential strength.

As can be seen from Tables 1 to 3, the mass percentages of C and V of Comparative Example 1 are lower than the range of elemental masses defined by the present invention, resulting in low hardenability and low strength after heat treatment. The mass percentages of C and Cr elements in Comparative Example 2 are too high, resulting in significant banded structure segregation. Therefore, the transverse impact energy of Comparative Example 2 is significantly decreased, and the range of yield strength and the range of tensile strength are large. Comparative Example 3 did not contain B and Ti elements, resulting in a decrease in transverse impact energy, a large range of yield strength and a large range of tensile strength. In Comparative Example 4, the mass percentage of Ca is too high, resulting in the formation of coarse non-metallic inclusions, which increases the brittleness and reduces the transverse impact energy of Comparative Example 4. In addition, in Comparative Example 4, Ti-3.4*N≤0, and thus BN is easily formed after heat treatment, which is not conducive to the improvement of strength and toughness of Comparative Example 4. In Comparative Example 5, the Mo content is high and the Ca/S ratio is less than 1.5, resulting in the formation of coarse MnS inclusions and carbides of Mo in Comparative Example 5, which reduces the transverse impact toughness.

FIG. 1 shows the microstructure of the high-strength and high-toughness tube for perforating gun of Example 5. As shown in FIG. 1, the microstructure of Example 5 is tempered sorbite and free of banded structure segregation, and MnS inclusions is in a level of 0.5 or less.

Figure 2:
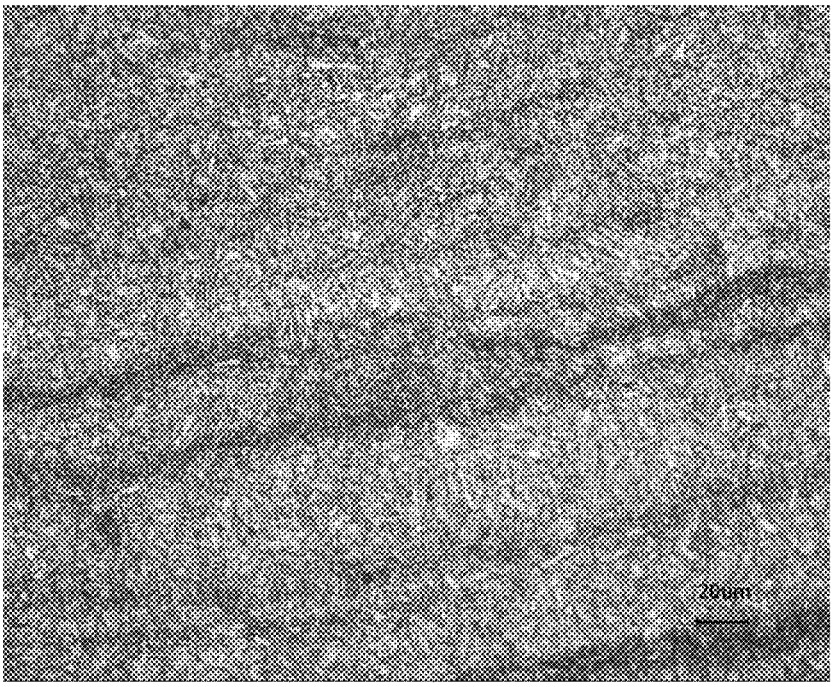
FIG. 2 shows the microstructure of a conventional tube for perforating gun of Comparative Example 2.

FIG. 2 shows the microstructure of a conventional tube for perforating gun of Comparative Example 2. As shown in FIG. 2, in Comparative Example 2, the banded structure segregation is significant due to the high mass percentages of the C and Cr elements.

Figure 3:
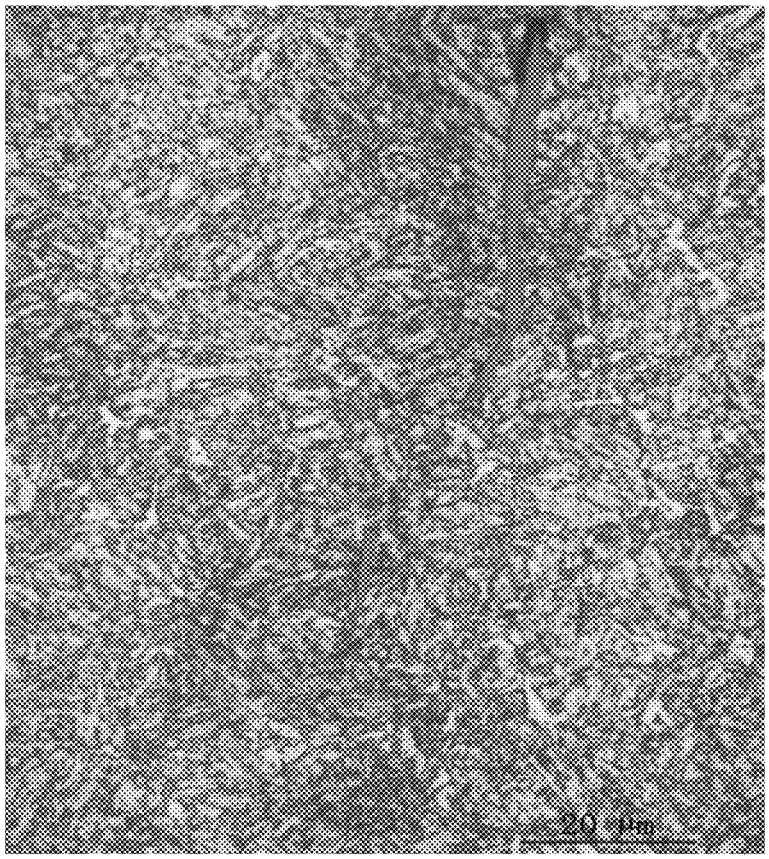
FIG. 3 shows the microstructure of a conventional tube for perforating gun of Comparative Example 5.

FIG. 3 shows the microstructure of a conventional tube for perforating gun of Comparative Example 5. As shown in FIG. 3, in Comparative Example 5, coarse MnS inclusions are formed.

It should be noted that the above are merely illustrative of specific Examples of the invention. It is obvious that the present invention is not limited to the above Examples, but has many similar variations. All modifications that are directly derived or associated by those skilled in the art are intended to be within the scope of the present invention.

The invention claimed is:

1. A high-strength and high-toughness tube for a perforating gun, comprising the following chemical elements by mass percentages:

C: 0.15%-0.22%, Si: 0.1%-0.4%, Mn: 0.5%-1%, Cr: 0.3%-0.7%, Mo: 0.3%-0.7%, Nb: 0.01%-0.04%, V: 0.1%-0.16%, Ti: 0.02%-0.05%, B: 0.0015%-0.005%, Al: 0.01%-0.05%, Ca: 0.001%-0.004%, N≤0.008%, and the balance of Fe and other inevitable impurities.

2. The high-strength and high-toughness tube for a perforating gun according to claim 1, wherein the tube for perforating gun further satisfies: 0<(Ti-3.4N)<0.025%.

3. The high-strength and high-toughness tube for a perforating gun according to claim 1, wherein the tube for perforating gun further satisfies: Ca/S≥1.5.

4. The high-strength and high-toughness tube for a perforating gun according to claim 1, wherein the tube for perforating gun has a microstructure of tempered sorbite.

5. The high-strength and high-toughness tube for a perforating gun according to claim 1, wherein the tube for perforating gun has a grain size level of 9 or more, and MnS inclusion level in the high-strength and high-toughness tube for perforating gun is 0.5 or less.

6. The high-strength and high-toughness tube for tube for a perforating gun according to claim 1, wherein the tube for perforating gun has a yield strength of 896~1103 MPa, a tensile strength of 965 MPa or more, and a transverse Charpy impact energy at 0° C. of 130 J or more, and the yield strength of the high-strength and high-toughness tube for perforating gun has a range of 60 MPa or less, and the tensile strength of high-strength and high-toughness tube for perforating gun has a range of 60 MPa or less.

7. The high-strength and high-toughness tube for a perforating gun according to claim 1, wherein the tube for perforating gun has a yield strength of 965~1173 MPa, a tensile strength of 1034 MPa or more, and a transverse Charpy impact energy at 0° C. of 130 J or more, and the yield strength of the high-strength and high-toughness tube for perforating gun has a range of 60 MPa or less, and the tensile strength of the high-strength and high-toughness tube for perforating gun has a range of 60 MPa or less.

8. The high-strength and high-toughness tube for a perforating gun according to claim 1, wherein the tube for perforating gun has a yield strength of 1069~1276 MPa, a tensile strength of 1138 MPa or more, and a transverse Charpy impact energy at 0° C. of 120 J or more, and the yield strength of the high-strength and high-toughness tube for perforating gun has a range of 60 MPa or less, and the tensile strength of the high-strength and high-toughness tube for perforating gun has a range of 60 MPa or less.

9. A manufacturing method for the high-strength and high-toughness tube for a perforating gun according to claim 1, comprising the steps of:

(1) smelting;

(2) casting: casting into a round billet, an electromagnetic stirring process under a current of 600~650 A and a frequency of 8~20 Hz is used in the casting process to reduce dendrite segregation of tube blank, and superheating degree of liquid steel in the casting process is controlled to be less than 30° C.;

(3) rolling;

(4) heat treatment; and (5) hot-sizing.

10. The manufacturing method according to claim 9, wherein in the step (3), the tube blank is soaked at 1200~1240° C., and then pierced at a temperature of 1180~1240° C.; rolling temperature is controlled at 950~1000° C.; the temperature of a reheating furnace is 950~1000° C.; stretch reducing temperature is 900~950° C.

11. The manufacturing method according to claim 9, wherein in the step (4), quenching is performed at first, wherein the quenching temperature is 880~920° C., and holding time is 30~60 min; tempering is then performed, wherein the tempering temperature is 550~650° C., and holding time is 50~80 min.

12. The manufacturing method according to claim 9, wherein in the step (5), the temperature of the hot-sizing is 500~550° C.

* * * * *